United States Patent [19]

Rehde et al.

[11] 4,100,992

[45] Jul. 18, 1978

[54] LOUDSPEAKER

[76] Inventors: Weber Louis Rehde; Joël Anders Rehde, both of 9 rue de la Mairie, Bavans (Doubs), France

[21] Appl. No.: 782,718

[22] Filed: Mar. 28, 1977

Related U.S. Application Data

[63] Continuation-in-part of Ser. No. 602,003, Aug. 5, 1975, abandoned.

[30] Foreign Application Priority Data

Aug. 12, 1974 [FR] France ..... 74 27923

[51] Int. Cl.[2] ..... G10K 13/00

[52] U.S. Cl. ..... 181/166; 181/167

[58] Field of Search ..... 181/164–167, 181/169, 170, 172

[56] References Cited

U.S. PATENT DOCUMENTS

| | | | |
|---|---|---|---|
| Re. 24,141 | 4/1956 | Brennan | 181/169 |
| 1,459,803 | 6/1923 | Steurer | 181/165 |
| 2,124,834 | 7/1938 | Stenger | 181/170 |
| 2,302,178 | 11/1942 | Brennan | 181/169 |
| 2,408,038 | 9/1946 | Brennan | 181/169 |
| 2,502,853 | 4/1950 | Keddie | 181/164 |
| 2,716,462 | 8/1955 | Brennan | 181/169 |

*Primary Examiner*—L. T. Hix
*Assistant Examiner*—Benjamin R. Fuller
*Attorney, Agent, or Firm*—Mason, Fenwick & Lawrence

[57] ABSTRACT

A loudspeaker including a porous diaphragm having an outside edge, an electromagnetic drive means mounted on a central area of the diaphragm for displacing the diaphragm and a hard ring forming a junction between the diaphragm and the drive means with the diaphragm being totally permeated with a stiffening material in the area between the ring and the outer edge without increasing the thickness of the diaphragm thereby improving the acoustic characteristics of the loudspeaker as compared with an equivalent unstiffened diaphragm.

5 Claims, 8 Drawing Figures

LOUDSPEAKER

This application is a continuation-in-part of application Ser. No. 602,003 filed Aug. 5, 1975, now abandoned.

This invention relates to loudspeakers of high output which produce high quality sound transmission.

Previously known loudspeakers do not ensure correct retransmission of sounds, and if the tone of various musical instruments heard directly is compared with that coming from these loudspeakers, it will be noticed that there is an absence of a large number of harmonics which results in an incorrect reproduction of these musical instruments by the loudspeakers.

Therefore the primary object of the present inventions is to provide of a new and improved loudspeaker.

Another object of the present invention is to provide a loudspeaker which reproduces the sounds of the musical instruments which are being transmitted. To achieve these objects the present invention provides a loudspeaker including a porous diaphragm fixed in its central zone to the bobbin of an electromagnetic drive element with the diaphragm being totally permeated with a stiffening material without increasing the thickness of the diaphragm. The junction between the diaphragm and the bobbin is provided with a ring of a hard or stiff material which adheres firmly to said diaphragm and to the bobbin.

The permeated portion of the diaphragm may be limited to a circular zone around the ring. The diaphragm may also carry, outside the permeated zone, various further zones covered by hard or stiff material, with these latter zones being independent of each other and extending out to the outer edge of the diaphragm.

A better understanding of the manner in which the subject invention achieves the foregoing objects as well as other objects and advantages of the invention will become more apparent when the following detailed description is considered in conjunction with the accompanying drawings described hereinafter.

Loudspeakers in accordance with the present invention, can even with very small displacements of the diaphragm produce exceptional output power without any appreciable intermodulation. These speakers are ideally suited for use with transistor circuits because slight displacements, produce high output with diaphragm lag being practically non existent.

Figure 1:
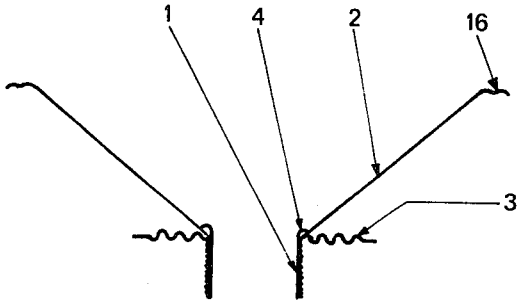
FIG. 1 is a schematic sectional view of a loudspeaker in accordance with the invention.

In FIG. 1, there is schematically shown a moving coil loudspeaker provided with a bobbin or spool 1 of the electromagnetic drive element and a diaphragm or membrane 2. This loudspeaker is also provided with a corrugated annular plate 3 called a "spider".

In accordance with the present invention, exceptional qualities of the loudspeaker are obtained by providing extreme rigidity or stiffness to the diaphragm, starting from its junction with the bobbin and going right up to its outside edge. This is basically obtained by arranging a ring or collar 4 of thick hard setting adhesive at the junction of the bobbin and the diaphragm, the effect of this collar being to substantially reinforce the base of the diaphragm in such a way as to obtain good sound transmission without loss of power from the fact that the diaphragm is so rigid.

Figure 2:
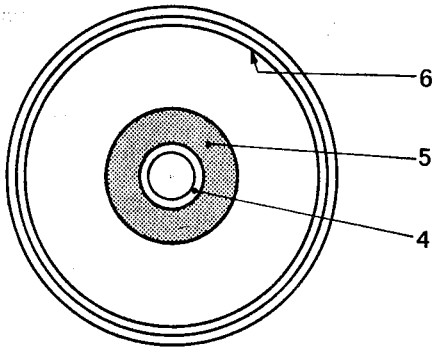
FIGS. 2 and 3 show two different stages of constructing a loudspeaker in accordance with the invention.

Starting from this collar 4 and going towards the outside edge of the diaphragm, the porous diaphragm is totally permeated with a stiffening material in an annular area 5 between the ring and the outer edge as shown in FIG. 2 without increasing the thickness of the diaphragm. The diameter of this annular area 5 varies according to the diameter and the type of loudspeaker. It being understood however, that good results have been obtained by making this zone 5 of a width equal to a third or a quarter of the radius of the loudspeaker.

Permeating the diaphragm with a stiffening material without increasing the thickness over the zone 5 outside the collar 4, also has the effect of increasing the rigidity or stiffness of the diaphragm.

Finally, the part of the diaphragm situated outside this zone 5 may be permeated in independent zones extending to the outside edge 6 of the membrane. This penetrant may be a varnish of cellulose type which is of sufficient fluidity to permit penetration into the texture of the very thin membrane forming the diaphragm without increasing the thickness. The penetrant permits transmission of sounds right to the edge of the diaphragm without the slightest distortion of the bass frequencies while providing good transmission of the medium and high frequencies.

Figure 3:
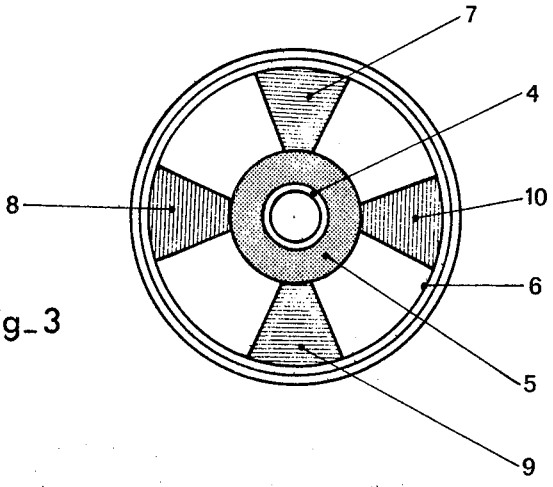

In the speaker shown in FIG. 3, there are four independent zones 7, 8, 9 and 10, arranged radially in the form of sectors. To still further increase the rigidity of the diaphragm, these sectors 7–10 may be cloth, paper or other material coated and bonded by use of a varnish or adhesive to the diaphragm.

Figure 4:
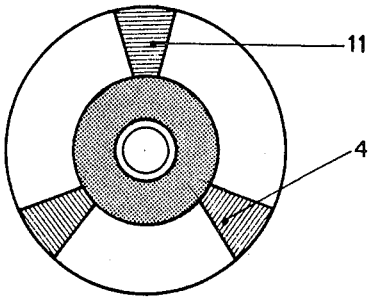
FIGS. 4 to 8 show various modifications of the loudspeaker in FIG. 3.
Figure 5:
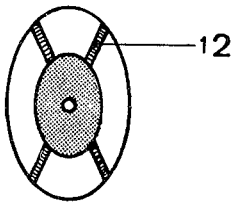

In the alternate embodiment of FIG. 4, three sectors 11 are arranged radially independently of one another and extend to the outside edge of the diaphragm. The elliptical loudspeaker in FIG. 5 includes four coated strips 12 of quite narrow width which extend to the outside edge of the diaphragm.

It is naturally understood that the present invention is equally applicable to an elliptical loudspeaker or any other shape of loudspeaker.

Figure 6:
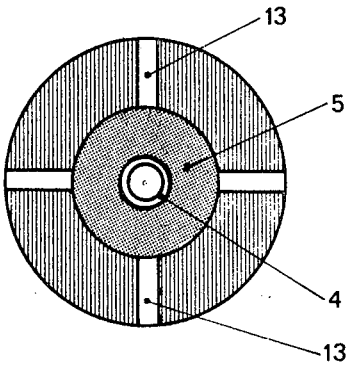

In contrast, in the arrangement of FIG. 6, the part of the diaphragm outside the annular zone 5 is entirely covered by a varnish or the like except for four strips 13 of narrow width arranged at 90° to each other.

Figure 7:
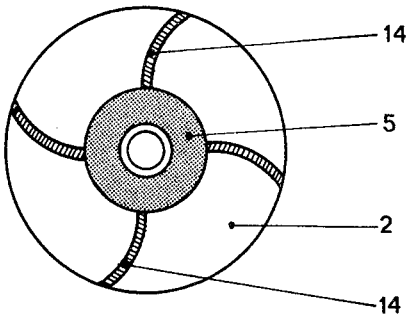

In FIG. 7, on the other hand, the zone of the diaphragm outside the permeated zone 5 carries four relatively narrow strips or bands of varnish 14 in the shape of an arc of a circle.

Figure 8:
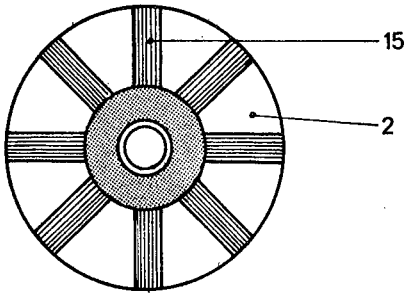

In the arrangement of FIG. 8, the outer zone of the diaphragm 2 is provided with a series of eight radial bands or strips 15 which ensure that the loudspeaker diaphragm has substantial rigidity or stiffness during the propagation of mechanical vibrations, right from the center portion of the membrane to its outside edge.

With loudspeakers of the present invention, an acoustic response band is obtained which is accurate and audible from a power input of 25 milliwatts whereas with good quality loudspeakers of the previously known type, 3 to 5 watts must be applied to obtain an acoustic pressure of the same intensity.

Loudspeakers in accordance with the present invention ensure high fidelity reproduction at low and at high power output without the slightest correction of flats or sharps through the amplifier. In addition, loudspeakers in accordance with this invention may have "spiders" and relatively hard peripheral corrugations and still reach extremely low and powerful frequencies with good sound transmission. This result is obtained basically because the penetration of the diaphragm with the stiffening material ensures a uniform displacement of its whole surface without the slightest flexing or bending. This increased rigidity of the diaphragm ensures correct axial positioning and centering of the moving bobbin which improves the fidelity of the output.

An additional advantage of loudspeakers according to the invention is that they are practically non-directional and do not resonate at certain frequencies.

It should be understood that the subject invention is susceptible to many modifications such as to other kinds of diaphragm loudspeakers which will be obvious to those of skill in the art and that the spirit and scope of the invention is to be limited solely by the appended claims.

We claim:

1. A loudspeaker comprising a porous diaphragm having an outside edge, an electromagnetic drive means mounted on a central area of the diaphragm for displacing the diaphragm and a hard ring forming a junction between said diaphragm and said drive means, said diaphragm being totally permeated with a stiffening material in a portion of the area between said ring and said outer edge without increasing the thickness of the diaphragm thereby improving the acoustic characteristics of said loudspeaker as compared with an equivalent unstiffened diaphragm.

2. The loudspeaker of claim 1, wherein the permeated portion of the diaphragm is a circular zone around the hard ring.

3. The loudspeaker of claim 1 wherein said ring is formed of an adhesive material.

4. The loudspeaker of claim 1 wherein said stiffening material is varnish.

5. The loudspeaker of claim 3 wherein said stiffening material is varnish.

* * * * *